US006643979B2

(12) United States Patent
Schlatter

(10) Patent No.: US 6,643,979 B2
(45) Date of Patent: Nov. 11, 2003

(54) TENSIONING DEVICE FOR DRUM AND CABLE WINDOW REGULATOR ASSEMBLY

(75) Inventor: Stanley Schlatter, Cookeville, TN (US)

(73) Assignee: Meriton Light Vehicle Technology, LLC., Troy, MI (US)

( * ) Notice: Subject to any disclaimer, the term of this patent is extended or adjusted under 35 U.S.C. 154(b) by 0 days.

(21) Appl. No.: 10/073,489

(22) Filed: Feb. 11, 2002

(65) Prior Publication Data

US 2003/0150166 A1 Aug. 14, 2003

(51) Int. Cl.[7] ..... E05F 11/48

(52) U.S. Cl. ..... 49/352; 49/506; 242/613; 242/602.1; 242/577.1

(58) Field of Search ..... 49/348, 349, 352, 49/506; 242/613, 602.1, 577.1

(56) References Cited

U.S. PATENT DOCUMENTS

| | | | | |
|---|---|---|---|---|
| 1,823,245 A | * | 9/1931 | Wittel | 242/613 |
| 2,906,470 A | * | 9/1959 | Fletcher | 242/613 |
| 4,428,250 A | * | 1/1984 | Becker et al. | 49/352 |
| 4,823,512 A | | 4/1989 | Maekawa et al. | |
| 4,922,783 A | | 5/1990 | Wallace | |
| 5,074,077 A | | 12/1991 | Toyoshima et al. | |
| 5,309,678 A | | 5/1994 | Adachi | |
| 6,061,963 A | * | 5/2000 | Osborn et al. | 49/352 |
| 6,260,782 B1 | * | 7/2001 | Smithson et al. | 242/613 |

FOREIGN PATENT DOCUMENTS

| | | | | |
|---|---|---|---|---|
| DE | 2441010 | * | 3/1975 | 49/352 |

* cited by examiner

*Primary Examiner*—Jerry Redman
(74) *Attorney, Agent, or Firm*—Carlson, Gaskey & Olds

(57) ABSTRACT

A window regulator assembly is provided that includes a guide defining a path. A window bar assembly having a window mounted thereon is supported on the guide and is movable along the path. A manual or automatic actuator is interconnected with a drum for rotationally driving the drum. A pair of cables each include an end connected to the drum with the opposing end connected to the guide. The cables are arranged in a pull-pull relationship between the drum and guide. A portion of the cables is wrapped about the circumference of the drum. A drum biasing assembly, which may include a mandrel urged into bore of the drum by a spring, expands the circumference of the drum to take up the slack in the cables. The drum includes radial grooves that divides the drum into sectors that are movable relative to one another by the mandrel.

15 Claims, 2 Drawing Sheets

TENSIONING DEVICE FOR DRUM AND CABLE WINDOW REGULATOR ASSEMBLY

BACKGROUND OF THE INVENTION

This invention relates to a window regulator assembly, and more particularly, the invention relates to a drum for taking up the slack in a drum and cable window regulator assembly.

Window regulator assemblies are used to raise and lower a window in a vehicle door. One type of window regulator assembly utilizes a drum driven by an actuator and a pair of cables connected to the drum. The cables are connected to a member supporting the window, which is mounted on a guide. The actuator rotates the drum and raises and lowers the member along the guide. To ensure desired operation of the window regulator, the cables should maintain a constant length.

Over the life of the window regulator assembly, the cables stretch undesirably. As a result, the window may not be raised or lowered in a desirable manner and may bind or make noise. Some tensioning devices have been proposed to take up the slack in the cables. The proposed tensioning devices may be rather complicated, or may not operate in a manner as desired. Therefore, what is needed is an improved and simplified window regulator tensioning device for a drum and cable assembly.

SUMMARY OF THE INVENTION AND ADVANTAGES

The present invention provides a window regulator assembly including a guide defining a path. A window bar assembly having a window mounted thereon is supported on the guide and is movable along the path. A manual or automatic actuator is interconnected with a drum for rotationally driving the drum. A pair of cables each include an end connected to the drum with the opposing end connected to the guide. The cables are arranged in a pull-pull relationship between the drum and guide. A portion of the cables is wrapped about the circumference of the drum. A drum biasing assembly, which may include a mandrel urged into bore of the drum by a spring, expands the circumference of the drum to take up the slack in the cables. The drum includes radial grooves that divides the drum into sectors that are movable relative to one another by the mandrel.

Accordingly, the above invention provides an improved and simplified window regulator tensioning device for a drum and cable assembly.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENT

Figure 1:
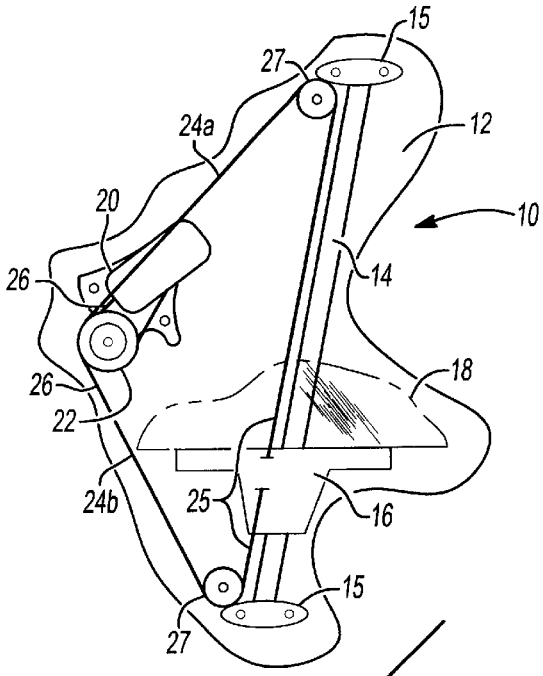
FIG. 1 is a schematic view of a drum and cable window regulator assembly.

A typical drum and cable window regulator assembly 10 is shown in FIG. 1. It is to be understood that the present invention may be used with a configuration other than the drum and cable window regulator assembly shown. The assembly 10 typically includes a guide 14 secured to a door panel or structure 12 by brackets 15. A window bar assembly 16, which may include multiple components movably or rigidly secured to one another, is supported on the guide 14 for movement along the guide. The window bar assembly 16 supports the window 18. An actuator 20, which may be manual or an electric motor, is supported on the door panel 12. A drum 22 is interconnected to the actuator 20, and may be directly mounted thereon as shown. The actuator 20 drives the drum 22 to move the window bar assembly 16 up and down along the guide 14, which defines the path of the window 18.

A typical drum and cable window regulator assembly 10 includes a pair of cables 24*a* and 24*b*. The cables 24 have a first end 25 connected to opposite sides of the window bar assembly 16. The second end 26 of the cables 24 are connected to the drum 22. Pulleys 27 are arranged between the drum 22 and window bar assembly 16 to support the cables 24. Portions of the cables 24 are wrapped about the drum 22. This type of drum and cable configuration is commonly referred to as a pull-pull configuration.

Figure 2:
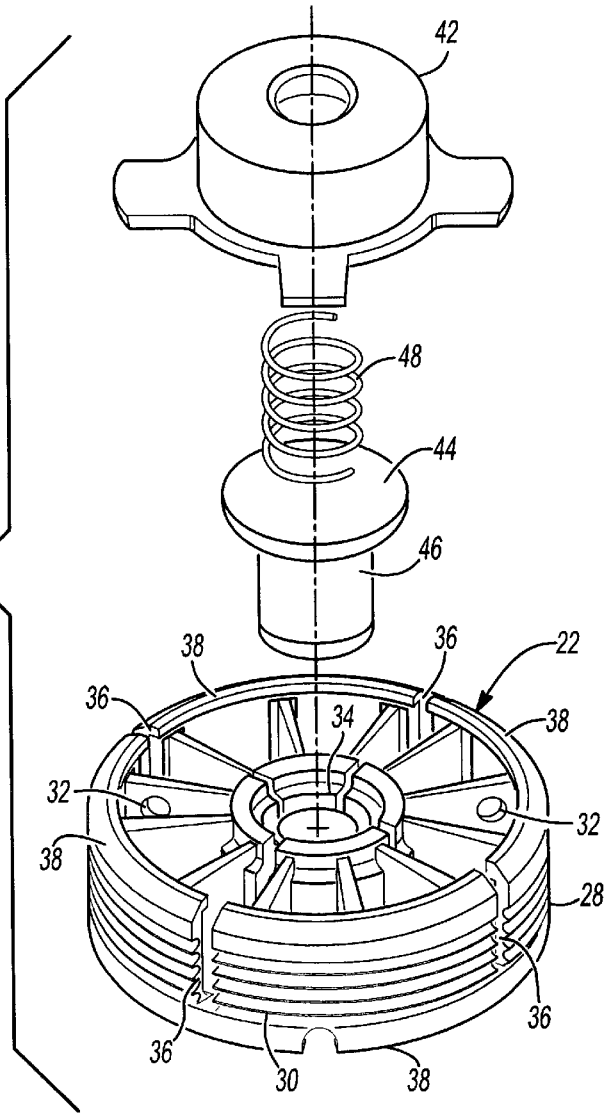
FIG. 2 is an exploded view of the drum and drum biasing assembly.
Figure 3:
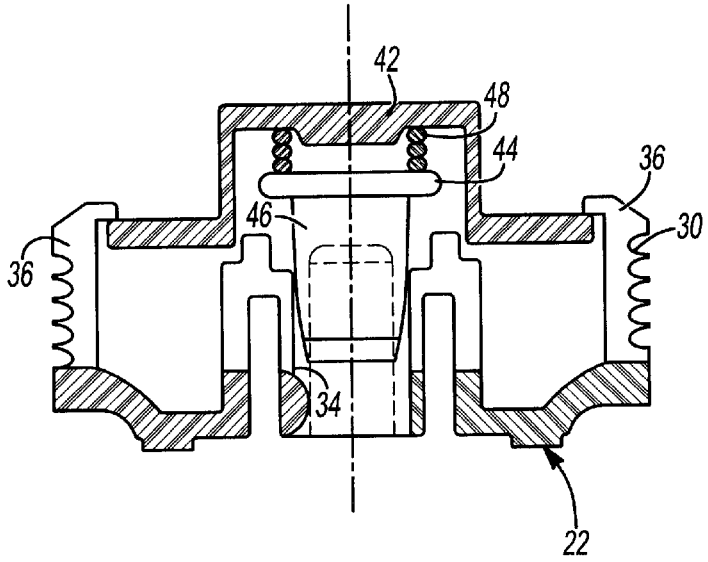
FIG. 3 is a cross-sectional view of the drum and drum biasing assembly.
Figure 4:
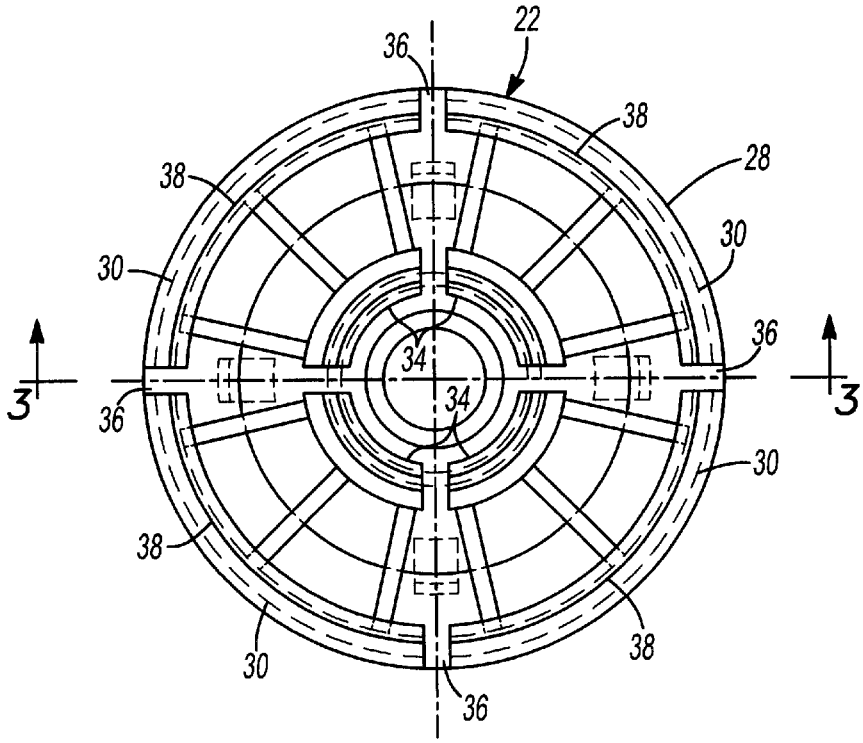
FIG. 4 is a top elevational view of the drum.

Referring to FIGS. 2–4, the drum 22 includes a circumference 28 that has a helical groove 30. The helical groove 30 guides the cables 24 as they wind about the drum 22. The drum 22 includes cable apertures 32 (only one of which is shown) that receive the second ends 26 of the cables in a known manner. The cable apertures 32 are adjacent the helical groove 30 where the cables 24 are received in the helical groove 30.

The cables 24 stretch over time. To this end, it is desirable to utilize a cable tensioning the device to take up the slack of the cables 24. The drum 22 has a bore 34 defined by an interior or reaction surface. A plurality of radial grooves 36, four of which are shown, are arranged on the drum 22 and define sectors 38. Any number of grooves and sectors may be used. A drum biasing assembly 40 cooperates with the bore 34 to expand the circumference 28 of the drum 22. The drum 22 is constructed from a sufficiently flexible material to permit the sectors 38 to move apart and outward from one another. The drum biasing assembly 40 may include a mandrel 44 having a tapered surface 46 of a frustoconical shape received in the bore 34. A retain 42 is secured to the drum 22. A spring 48 is arranged between the retainer 42 and the mandrel 44 to urge the mandrel 44 further into the bore 34. As the cables 24 stretch, the mandrel 44 will be forced into the bore 34 by the spring 48 to move the sectors 38 outward and away from one another and expand the circumference 28 of the drum 22. In this manner, the drum 22 has the ability to take up the slack in the cables 24.

Drum and cable window regulator assemblies operate with cables 24 having a constant length. That is to say, as the drum 22 is driven by the actuator 20, the overall length of the cables 24 is not shortened or lengthened. Said another way, the drum 22 has the same length of cable 24 wrapped around it throughout its operation. However, as the cables stretch the length of the cables 24 increases so that the portions of the cables 24 not wrapped about the drum 22 have slack, which may inhibit the desirable operation of the window regulator assembly 10. With the present invention, as the cables 24 stretch the drum 22 automatically expands. During operation of the window regulator assembly, the slack in the cables 24 is wrapped about the expanded circumference of the drum 22 and taken up.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims the invention may be practiced otherwise than as specifically described.

What is claimed is:

1. A window regulator assembly comprising:

a guide defining a path;

a window bar assembly supported on said guide and movable along said path;

an actuator interconnected with a drum for rotationally driving said drum;

a pair of cables with each of said cables having one end connected to said drum and another end connected to said guide, and a portion of said cables wrapped about a circumference of said drum; and a drum biasing assembly coacting with said drum and expanding said circumference for taking up slack in said cables, wherein said drum biasing assembly includes a reaction surface on said drum and a resilient member generating a force on said reaction surface expanding said circumference, and wherein said drum biasing assembly includes a mandrel interposed between said resilient member and said reaction surface with said resilient member forcing said mandrel into said reaction surface to expand said circumference.

2. The window regulator assembly according to claim 1, wherein said drum includes a bore defining said reaction surface with one of said reaction surface and said mandrel is tapered.

3. The window regulator assembly according to claim 2, wherein said mandrel includes a frustoconical outer surface received in said bore.

4. The window regulator assembly according to claim 1, wherein said resilient member is a coil spring.

5. The window regulator assembly according to claim 1, wherein said drum biasing assembly includes a retainer with said resilient member interposed between said drum and said retainer.

6. The window regulator assembly according to claim 5, wherein said retainer is secured to said drum.

7. The window regulator assembly according to claim 1, wherein said drum includes a plurality of radial grooves defining a plurality of sectors with said sectors movable relative to one another in response to said resilient member forcing said mandrel into said reaction surface to expand said circumference.

8. A drum assembly for a window regulator comprising:

a drum including an axial bore and including a circumference with a cable aperture; and a biasing assembly having a resilient member coacting with said bore and generating a force on said bore to expand said circumference, wherein said drum biasing assembly includes a mandrel interposed between said resilient member and said reaction surface with said resilient member forcing said mandrel into said bore to expand said circumference.

9. The drum assembly according to claim 8, wherein one of said bore and said mandrel is tapered.

10. The drum assembly according to claim 9, wherein said mandrel includes a frustoconical outer surface received in said bore.

11. The drum assembly according to claim 8, wherein said resilient member is a coil spring.

12. The drum assembly according to claim 8, wherein said drum biasing assembly includes a retainer secured to said drum with said resilient member interposed between said drum and said retainer.

13. A drum assembly for a window regulator comprising:

a drum including an axial bore and including a circumference with a cable aperture;

a biasing assembly having a resilient member coacting with said bore and generating a force on said bore to expand said circumference; and wherein said drum includes a plurality of radial grooves defining a plurality of sectors with said sectors movable relative to one another in response to said resilient member forcing said mandrel into said bore to expand said circumference.

14. A method of taking up slack in a window regulator assembly comprising the steps of:

a) providing a window regulator assembly with a drum and cable;

b) expanding a circumference of the drum by urging a mandrel into a bore in the drum; and c) wrapping the cable around the drum.

15. The method according to claim 14, wherein step b) forcing a plurality of radial drum sectors away from one another.

* * * * *